US011490703B1

(12) United States Patent
Norcross et al.

(10) Patent No.: US 11,490,703 B1
(45) Date of Patent: Nov. 8, 2022

(54) LONG HAIR SHAMPOOING AND WASHING BOWL

(71) Applicants: Stefaney Norcross, Lansing, MI (US); James Norcross, Lansing, MI (US)

(72) Inventors: Stefaney Norcross, Lansing, MI (US); James Norcross, Lansing, MI (US)

( * ) Notice: Subject to any disclaimer, the term of this patent is extended or adjusted under 35 U.S.C. 154(b) by 0 days.

(21) Appl. No.: 17/393,527

(22) Filed: Aug. 4, 2021

Related U.S. Application Data

(60) Provisional application No. 63/211,483, filed on Jun. 16, 2021.

(51) Int. Cl.
*A45D 19/10* (2006.01)
*E03C 1/14* (2006.01)

(52) U.S. Cl.
CPC ..... *A45D 19/10* (2013.01); *E03C 1/14* (2013.01)

(58) Field of Classification Search
CPC ..... A45D 19/12; A45D 19/08; A45D 19/06; A45D 19/10; E03C 1/14
USPC ..... 4/650, 520
See application file for complete search history.

(56) References Cited

U.S. PATENT DOCUMENTS 1,898,314 A * 2/1933 Sandhagen ..... E03C 1/04 4/519
2,672,255 A * 3/1954 Mustee ..... D06F 39/12 312/228
3,292,186 A * 12/1966 Turmenne ..... A47C 1/10 4/519
4,763,364 A * 8/1988 Morgan ..... A45D 44/10 4/523
6,925,660 B1 * 8/2005 Cartwright ..... A45D 44/10 4/523
2003/0019026 A1 * 1/2003 Hatanaka ..... A45D 19/10 4/519
2006/0053545 A1 * 3/2006 Schulken ..... A45D 19/10 4/515
2006/0174404 A1 * 8/2006 Sullivan ..... A45D 19/06 4/520
2007/0044225 A1 * 3/2007 Palacios ..... A45D 19/04 4/516
2013/0219608 A1 * 8/2013 Sclafani ..... A45D 19/08 4/518
2022/0053917 A1 * 2/2022 Johansson ..... E03C 1/264

* cited by examiner

*Primary Examiner* — Benjamin R Shaw
(74) *Attorney, Agent, or Firm* — Brennan, Manna & Diamond, LLC

(57) ABSTRACT

The present invention relates to a long hair shampooing and washing bowl having a hair washing cavity/basin defined by a plurality of walls. The bowl is taller than conventional bowls/sinks, and has a greater depth to accommodate long hair and prevent hair from clogging the drain and getting tangled. The bowl has an integrated drain outlet connected to a drainage pipe to drain out the rinsed water, and a notch for supporting the neck of a user. The walls of the cavity are slanted, thereby allowing a stylist to effectively work on a user's hair and effectively rinse the hair without hair gathering at the drain outlet.

15 Claims, 5 Drawing Sheets

LONG HAIR SHAMPOOING AND WASHING BOWL

CROSS-REFERENCE TO RELATED APPLICATION

The present application claims priority to, and the benefit of, U.S. Provisional Application No. 63/211,483, which was filed on Jun. 16, 2021 and is incorporated herein by reference in its entirety.

FIELD OF THE INVENTION

The present invention relates generally to the field of hair rinsing sinks. More specifically, the present invention relates to an improved shampoo bowl for hair salons, that is taller and longer than standard hair rinsing bowls, and allows a user's hair to be easily washed and fully combed out. The elongated and deep shampoo bowl comprises a U-shaped cut-out at its front portion to allow a user to keep his or her neck out of the bowl and dangle the hair inside the bowl to allow a user's hair to be cleaned, colored or toned completely. Additionally, the shampoo bowl comprises a deep U-shaped cut out at its rear portion to allow the salon assistant or other user to easily and fully access the client's hair, while preventing the hair from tangling. Accordingly, the present disclosure makes specific reference thereto. Nonetheless, it is to be appreciated that aspects of the present invention are also equally applicable to other like applications, devices and methods of manufacture.

BACKGROUND OF THE INVENTION

By way of background, hair washing sinks are quite commonly used at salons and/or beauty parlors for rinsing and/or washing hair or for applying hair treatments. The hair washing sink is generally a shallow bowl-like structure having a slight cut-out to allow a user to rest their head and dangle their hair inside the bowl structure for washing and rinsing purposes. However, hair can be difficult for a hair stylist to rinse, especially in a shallow shampoo bowl filled with suds. The longer the hair, the more difficult it is for the hair stylist to rinse and/or treat the hair. Typically, long hair bunches up in the shallow bowl/sink and often clogs the drainage outlet, preventing water from draining out of the sink. This may cause water to fill up inside the hair washing sink, which causes the hair in the sink to not be cleaned properly.

Additionally, the bunching of a user's hair causes substantial tangling, which requires additional time for the hair stylist to untangle a user's hair. The tangled hair can be difficult and painful to comb. The hair stylist may struggle with the tangled hair for longer than necessary, ultimately leading to an unhappy client. Further, additional time is spent on the tangled hair, which causes the stylist to have less time with other clients.

Furthermore, when a user applies color, toner or shampoo to hair, the products need to be fully and completely applied throughout the hair of the client. Again, hair stylists can find it difficult to apply shampoo, color, toner or other hair treatment products over long hair. Clients with long hair may not have a great experience at salons and beauty parlors, and may remain unsatisfied with their services.

Apart from the above-mentioned problems, the hair stylists may also be uncomfortable in providing hair treatment services to clients while using the shallow hair washing sinks, since the standard hair washing sinks are shallow and are short in height, and require the hair stylist to constantly bend down to access the shampoo bowls throughout the hair treatment process. Thus, conventional hair washing sinks are uncomfortable for both clients and the hair stylists.

Therefore, there exists a long felt need in the art for a hair washing sink that enhances the overall client experience at salons and beauty parlors. There is also a long felt need in the art for an improved hair washing sink that prevents a user's hair from being tangled while performing hair treatments. Additionally, there is a long felt need in the art for a hair washing sink that allows hair stylists to access the full length of the client's hair without tangling it. Moreover, there is a long felt need in the art for a hair washing sink that prevents a user's hair from being bunched and tangled, and therefore prevents clogging of the drain outlets of the sinks. Further, there is a long felt need in the art for a hair washing sink that allows a hair stylist to easily apply hair treatment products such as shampoo, toner, color or the like, throughout the length of a client's hair. Furthermore, there is a long felt need in the art for a hair washing sink that allows hair stylists to quickly provide hair-related services to their clients, and ensures that the clients remain satisfied and/or happy. Finally, there is a long felt need in the art for a hair washing sink that is comfortable for both clients and hair stylists, and enhances the overall salon experience for the users.

The subject matter disclosed and claimed herein, in one embodiment thereof, comprises a long hair shampooing and washing bowl. The long hair shampooing and washing bowl is taller and has a longer depth than standard hair washing bowls. More specifically, the bowl is a single piece body component, the body has slanted walls which slant upward from the center and bottom of the bowl. The slanted walls form a cavity wherein the cavity is long enough to accommodate the long hair of a client. A front wall has a U-shaped notch shaped to receive and support the neck of the client, and a rear wall having a deep, U-shaped cut-out allowing a stylist to easily apply toner, color, and/or shampoo and rinse the client's hair. The bowl has a drainage outlet at the bottom center which is connected to a drainage pipe for draining wastewater from the bowl.

In this manner, the novel long hair shampooing and washing bowl of the present invention accomplishes all of the forgoing objectives, and provides a relatively safe, easy and convenient solution to allowing a user's hair to be washed and/or treated without causing it to become tangled. The bowl also ensures that the hair does not clog the drain outlets of the bowl and does not remain in the accumulated water in the bottom of the bowl. The bowl allows the hair stylist to easily apply hair treatment products such as shampoo, toner, color, etc., throughout the length of a client's hair while utilizing less water.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a long hair shampooing and washing bowl device. The long hair shampooing and washing bowl device is designed to be taller than a conventional shampoo bowl to allow for use with long hair. The bowl device comprises a single piece body component manufactured of ceramic, plastic, powder coated metal, stainless steel, or glass, etc., or any other suitable material as is known in the art. The body further comprises a pair of opposing walls which slant upward from a bottom center of the body, forming a cavity or basin wherein the cavity is long enough to accommodate a user's long hair. The body further comprises a front wall having a U-shaped notch shaped to receive and support the neck of the user, and a rear wall having a deep U-shaped cut-out which allows a stylist to easily apply toner, color and/or shampoo and rinse the hair. The bowl device also has a drain outlet at the bottom center of the body, which is connected to a drainage pipe for draining wastewater from the bowl device. In yet another embodiment of the present invention, the vertical height between the U-shaped notch for the user's neck and the drain outlet is approximately three feet, thereby preventing a user's hair from clogging the drain outlet.

In yet another embodiment of the present invention, a hair shampooing and washing sink device for washing and rinsing hair from a user's head is disclosed. The hair shampooing and washing sink device includes a cavity/basin formed by a pair of opposing slanted walls, a U-shaped or semi-circular notch on a front wall for supporting a user's neck and allowing a user's hair to dangle or hang into said cavity, a drainage outlet at the bottom of the cavity such that the distance between the U-shaped or semi-circular notch and the drain outlet is long enough to accommodate long hair without clogging the drain outlet with said hair. Further, the sink device is narrower at the bottom of the cavity and broader at the top, due to the pair of opposing walls slanting upwards.

In yet another embodiment of the present invention, an improved shampooing bowl device for long hair is disclosed. The shampooing bowl device is larger and taller in height than a conventional bowl, allowing a user's hair to be combed out within the bowl. The shampoo bowl device includes a base to allow the bowl to be positioned on a flat surface, a U-shaped or semi-circular notch is positioned in a front wall for supporting a user's neck, a cavity or basin is provided to accommodate a user's hair and the U-shaped or semi-circular notch is at a non-perpendicular angle relative to the base, to allow efficient and effective washing and/or treatment of long hair.

In yet another embodiment of the present invention, the bowl/sink device is configured to have a depth greater than the length of hair hanging from a user's head when said user's neck is supported by the U-shaped or semi-circular notch. In yet another embodiment of the present invention, the shampoo bowl device is a backwash shampoo bowl, and has cushioning support on the U-shaped or semi-circular notch.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
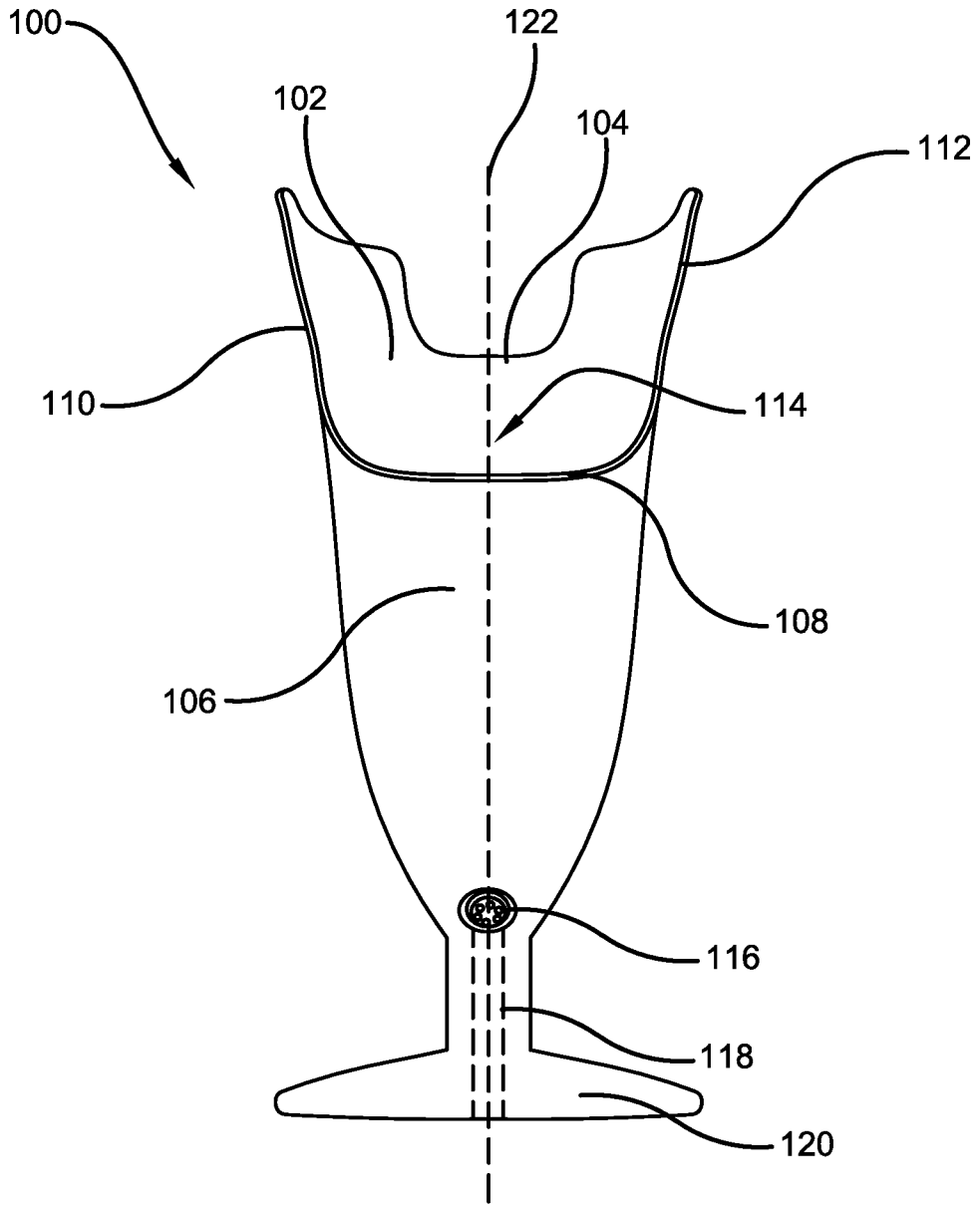
FIG. 1 illustrates a front perspective view of one potential embodiment of the long hair shampooing and washing bowl device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long felt need in the art for a hair washing sink that enhances the overall client experience at salons and beauty parlors. There is also a long felt need in the art for an improved hair washing sink that prevents a user's hair from being tangled. Additionally, there is a long felt need in the art for a hair washing sink that allows a hair stylist to access the full length of a user's hair. Moreover, there is a long felt need in the art for a hair washing sink that prevents a user's hair from being bunched and tangled in the sink, and thereby clogging the sink drain. Further, there is a long felt need in the art for a hair washing sink that allows a hair stylist to easily apply hair treatment products such as shampoo, toner, color, etc., throughout the length of a user's hair. Furthermore, there is a long felt need in the art for a hair washing sink that allows a hair stylist to quickly provide hair-related services to a user, and ensures the user remains satisfied/happy. Finally, there is a long felt need in the art for a hair washing sink that is comfortable for both users and hair stylists, and enhances the overall salon experience for the users.

The present invention, in one exemplary embodiment, is a novel hair shampooing and washing sink device for washing and rinsing a user's hair. The hair shampooing and washing sink device includes a cavity formed by a pair of opposing slanted walls, a U-shaped or semi-circular notch on the front wall for supporting a user's neck while allowing hair to dangle or hang into said cavity and a drain outlet at the bottom of the cavity such that the distance between the U-shaped or semi-circular notch and the drain outlet is long enough to accommodate a user's long hair. The sink device is narrower at the bottom of the cavity and broader at the top, due to the pair of opposing side walls slanting upwards.

Referring initially to the drawings, FIG. 1 illustrates a front perspective view of one embodiment of the long hair shampooing and washing bowl device of the present invention. The long hair shampooing and washing bowl device 100 of the present invention is designed to be used for washing and rinsing a user's hair at a salon or any other suitable place as is known in the art. The shampoo bowl device 100 is taller and has a greater depth than conventional shampoo bowls known in the art, and thus allows a user's long hair to hang down into the bowl device 100. The depth of the shampoo bowl device 100 is large enough to accommodate various lengths of hair to be shampooed and rinsed, and still avoids tangling and discomfort for the user. The shampoo bowl device 100 of the present invention is typically positioned behind a hair care chair and is adapted for washing and rinsing a user's hair while sitting in the hair care chair.

The shampoo bowl device 100 comprises a single piece construction having a depressed structure with a depth to accommodate long lengths of hair. The shampoo bowl device 100 is generally rectangular with a slanted and slightly rectangular front wall 102, having a U-shaped notch 104 for supporting the neck and head of a user during shampooing and rinsing the hair. The rear wall 106 of the shampoo bowl device 100 has a height less than the front wall 102 allowing a stylist to easily access a user's hair to wash and rinse the hair. The rear wall 106 has a deep U-shaped cut-out 108 causing the rear wall 106 to be shorter in height than the front wall 102. A plurality of opposing side walls 110, 112 extend between the front wall 102 and the rear wall 106. The front wall 102, the rear wall 106 and the opposing side walls 110, 112 are integrally molded to form a single piece construction which forms a depression or cavity/basin 114 for accommodating a user's long hair. It should be appreciated that the shampoo bowl device 100 is a backwash bowl with the U-shaped notch 104 supporting the user's neck and head. In one embodiment, the U-shaped notch 104 can be formed in the general shape of a semi-circle and substantially contours the head/neck area of the user. However, the U-shaped notch 104 can be any suitable shape and size as is known in the art.

The shampoo bowl device 100 has a drain outlet 116 disposed at the bottom center of the cavity 114 and is connected to a drainage pipe 118 for draining water and shampoo. The shampoo bowl device 100 can be placed over a floor drain such that waste water can be easily disposed from the drain outlet 116 to the drainage pipe 118, and then disposed through the floor drain. In a preferred embodiment, the vertical distance (depth) between the U-shaped notch 104 and the drain outlet 116 is at least three feet, but can be any suitable distance as is known in the art. The increased depth of the shampoo bowl device 100 does not allow the drain outlet 116 to clog up with a user's hair, and thus the water and shampooing products easily flow out of the drain outlet 116 and through the drainage pipe 118. The shampoo bowl device 100 can also be easily placed on any flat surface and has a broad base 120 which balances and supports the shampoo bowl device 100.

The shampoo bowl device 100 has a narrow width near the drain outlet 116 and a larger width near the top, thereby allowing the stylist to easily wash and rinse a user's hair. Further, the walls 102, 106, 110, 112 are slanted at approximately thirty degrees from a virtual longitudinal axis 122 measured at the drain outlet 116 wherein the walls 102, 106, 110, and 112 slant upwards and outwards from the drain outlet 116 towards the top of the cavity 114. Due to the slanting shape of the front wall 102, the U-shaped notch 104 is positioned at a non-perpendicular angle relative to the base 120 of the shampoo bowl device 100.

In the present embodiment, the shampoo bowl device 100 is manufactured from a ceramic material although it will be appreciated that the construction and material is not limited thereto, and that the shampoo bowl device 100 can be manufactured from any suitable material as is known in the art, such as plastic, powder coated metal, stainless steel, glass, etc. The shampoo bowl device 100 can be connected to the standard plumbing and drainage system inside a salon or any other suitable business for effective water supply and/or drainage output.

Figure 2:
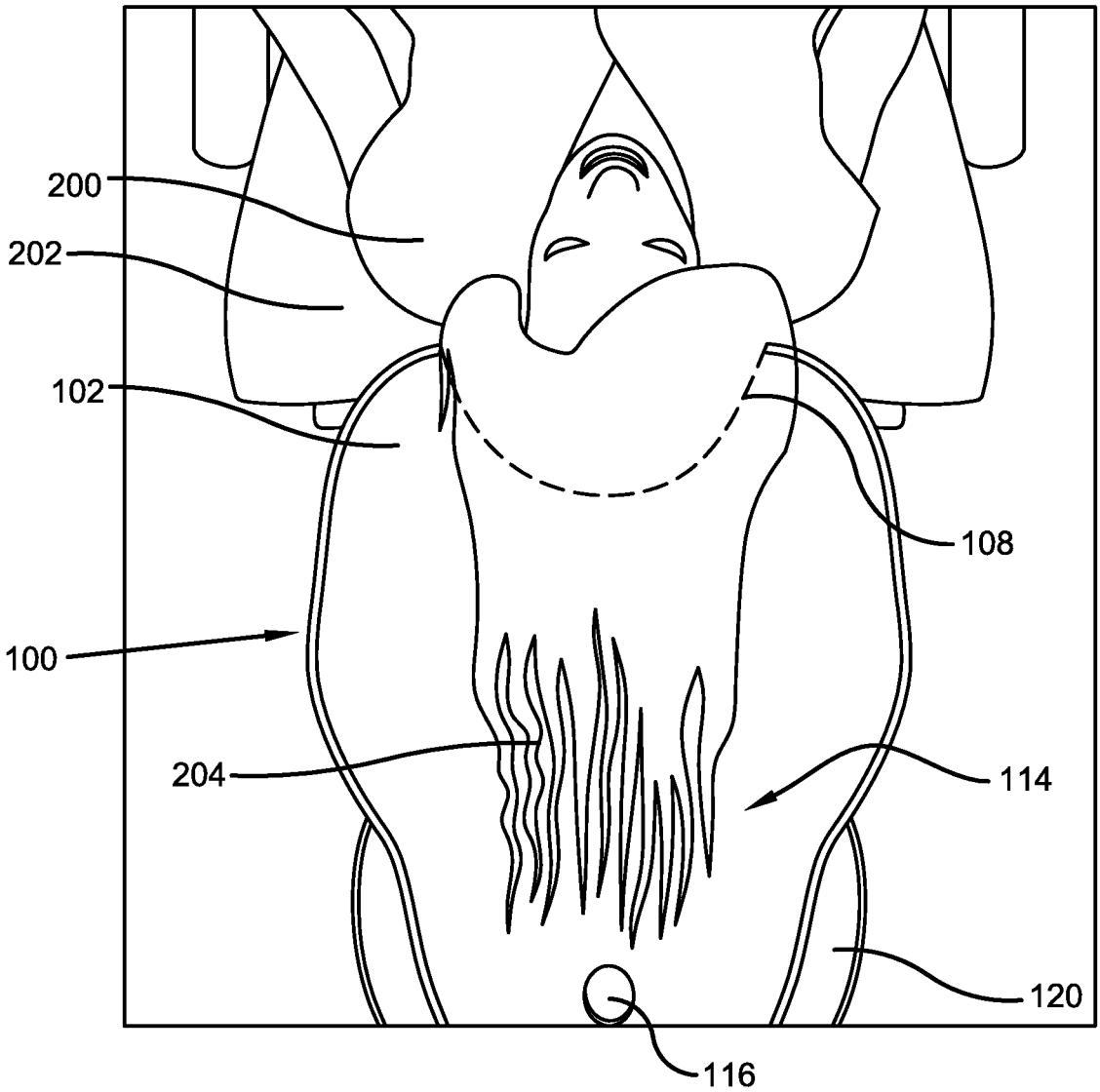
FIG. 2 illustrates a top perspective view showing a user's hair hanging into one potential embodiment of the long hair shampooing and washing bowl device of the present invention in accordance with the disclosed architecture.

FIG. 2 illustrates a top perspective view showing a user's hair hanging in the long hair shampooing and washing bowl device of the present invention. A user 200 reclines on a hair care chair 202 and rests the neck on the U-shaped notch 108 of the shampooing bowl device 100, which is positioned behind the hair care chair 202 for performing backwashing of a user's hair 204. The cavity/basin 114 of the shampooing bowl device 100 allows the user's 200 hair 204 to hang without clogging the drain outlet 116 and without coming in contact with the dirty water accumulated near the drain outlet 116. The hair 204, when wet, can adhere to the front wall 102 and thus does not tangle.

It should be appreciated that the depth of the cavity/basin 114 i.e., the vertical distance between the U-shaped notch 108 and the drain outlet 116 is long enough to accommodate hanging hair of up to three feet. In the present embodiment, the U-shaped notch 108 can also have a soft cushion (not shown) made of foam or soft silicon, or any other suitable cushioning material as is known in the art to support a user's neck. Using the soft cushion of the U-shaped notch 108 allows a user's neck to be comfortable while the hair 204 is being treated and/or washed.

Figure 3:
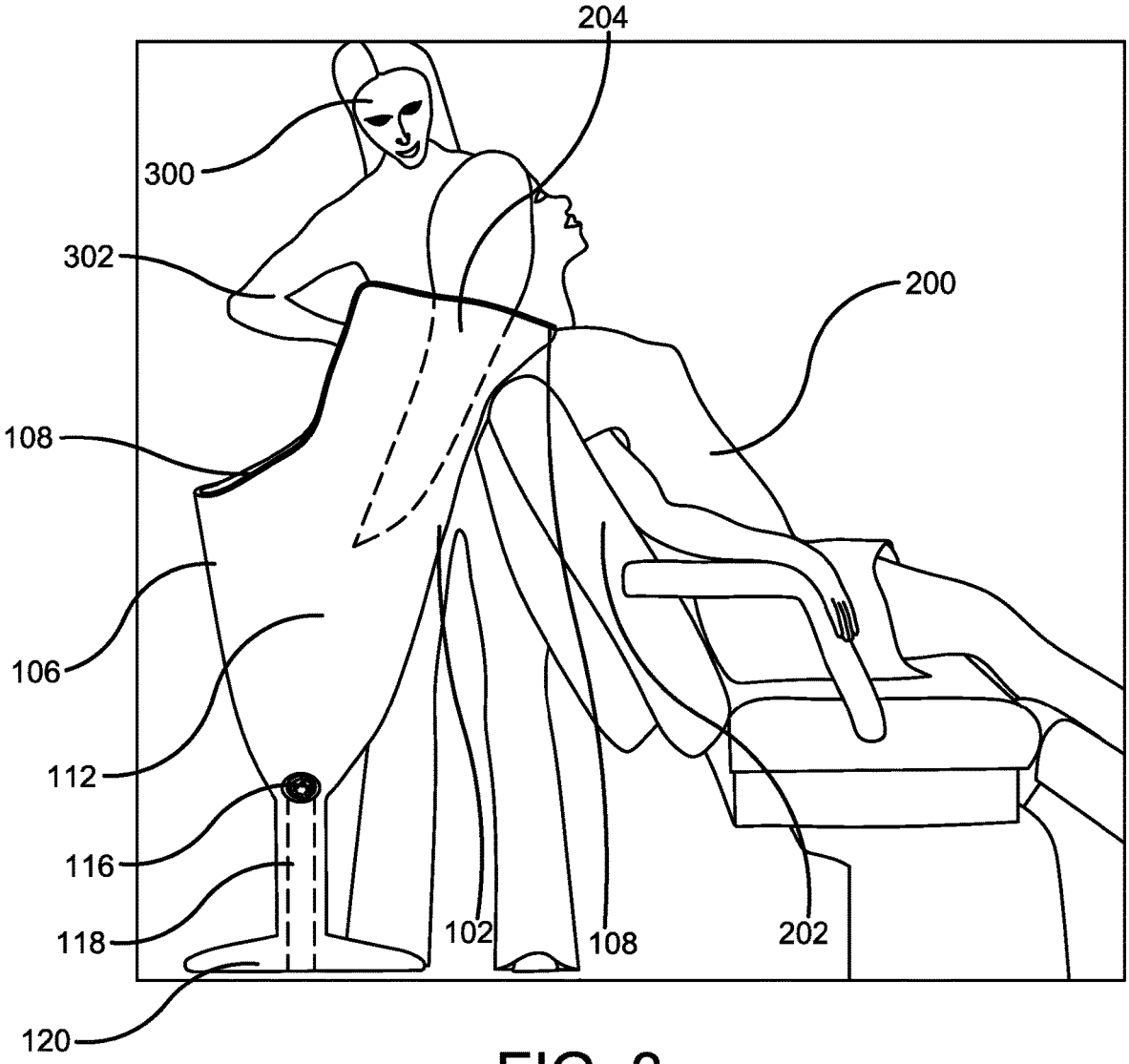
FIG. 3 illustrates a side perspective view showing one potential embodiment of the long hair shampooing and washing bowl device in use in accordance with the disclosed architecture.

FIG. 3 illustrates a side perspective view showing the shampoo bowl device in use. The shampoo bowl device 100 comprises a slanting front wall 102 that slants upward and outward from the bottom drain output 116 towards the U-shaped notch 108, thereby allowing the shampoo bowl device 100 to be placed next to or behind a salon chair 202. A user 200 easily places his or her neck on the U-shaped notch 108, thereby allowing a stylist 300 to access the hair 204 which is hanging in the cavity of the shampoo bowl device 100. The deep U-shaped cut-out 108 of the rear wall 106 allows the stylist 300 to easily access, wash and rinse all parts of a user's hair 204 using their hands 302. The stylist 300 does not need to bow down or bend over while washing and rinsing a user's hair 204.

Further, the water, shampoo and other hair-cleaning agents can easily flow out from the drain outlet 116 through the drainage pipe 118. It should also be noted that the drainage pipe 118 is connected to an external drainage pipe for draining the wastewater out from the shampoo bowl device 100. The shampoo bowl device 100 is portable and can be easily placed at any convenient location, preferably near a salon or hair care chair 202.

It should be appreciated that the hair washing bowl device has a bowl-depth configured to accommodate long hair 204 extending from the head of a user 200, without the user's hair contacting the drain outlet 116 during the hair-washing and rinsing processes performed by the stylist 300. Further, the stylist 300 can fully comb, remove tangles, apply shampoo and apply toner from the roots to the ends of a user's hair without any bending or discomfort.

Figure 4:
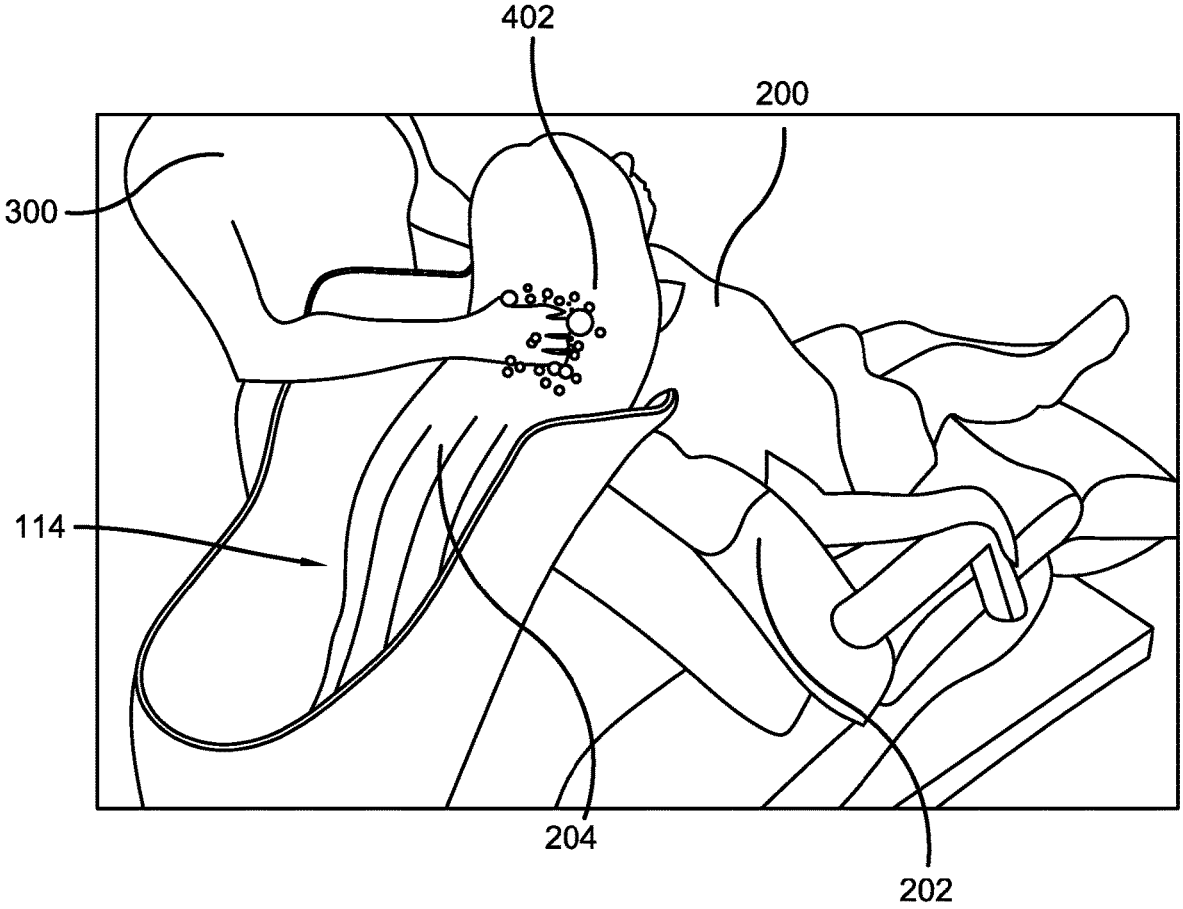
FIG. 4 illustrates a perspective view showing a user getting her hair shampooed by a stylist in one potential embodiment of the long hair shampooing and washing bowl device of the present invention in accordance with the disclosed architecture.

FIG. 4 illustrates a perspective view showing a user getting his or her hair shampooed by a stylist in the long hair washing sink device of the present invention. The user 200 can easily and comfortably sit and recline in a salon chair 202 and the stylist 300 can easily apply shampoo 402 on the long hair 204 of the user 200 hanging in the sink device 100. The long hair 204 is easily accommodated in the cavity 114 without touching the drain outlet and accumulated wastewater, thereby providing hygiene and safety to both the user 200 and the stylist 300. The shampoo 402 can then be easily rinsed off without interrupting operation of the user's 200 hair washing.

Figure 5:
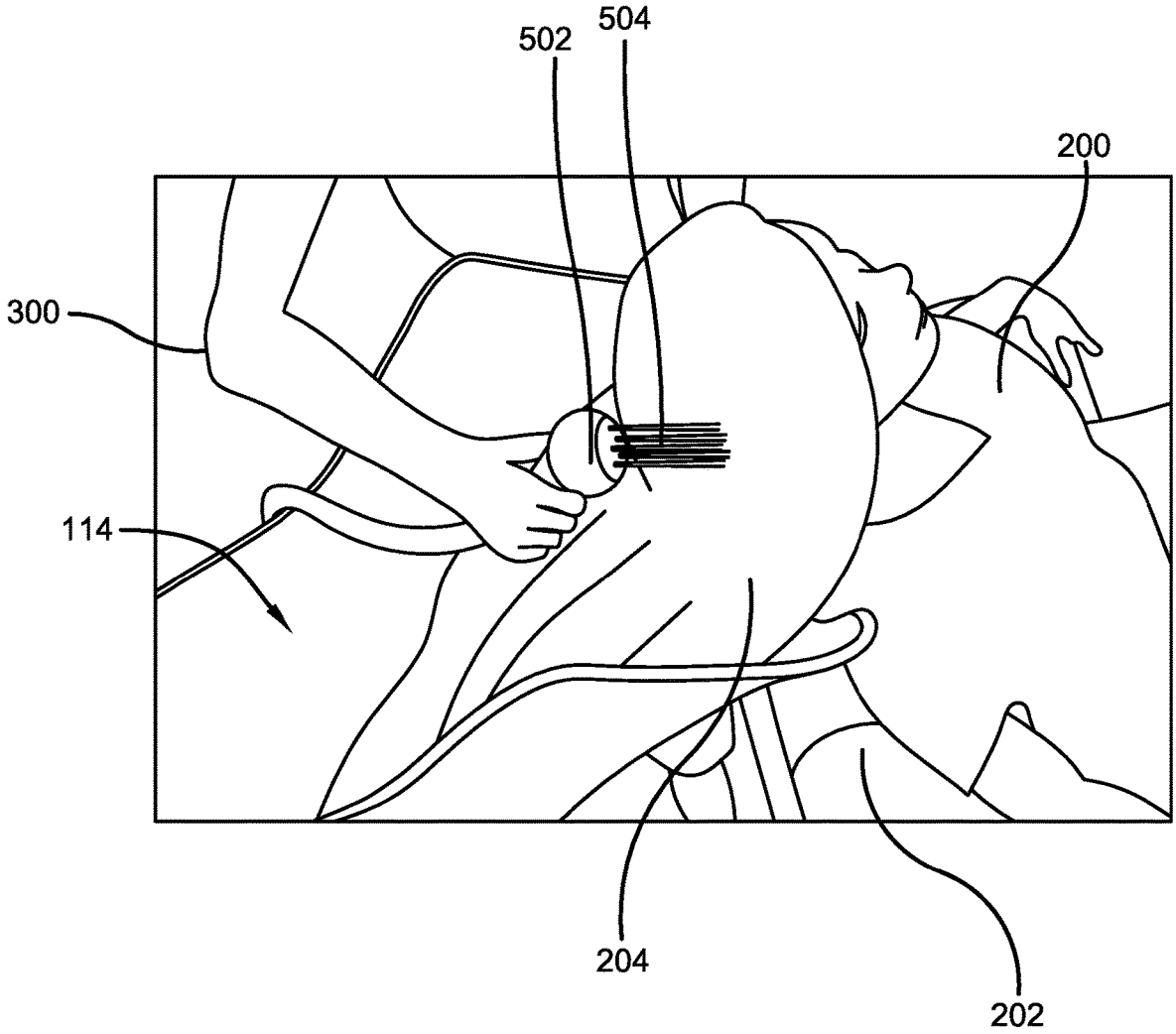
FIG. 5 illustrates a perspective view showing a user getting her hair rinsed with water by a stylist in one potential embodiment of the long hair shampooing and washing bowl device of the present invention in accordance with the disclosed architecture.

FIG. 5 illustrates a perspective view showing a user getting his or her hair rinsed with water by a stylist in the long hair washing sink device of the present invention. When rinsing hair 204 with water 504, a user 200 can easily and comfortably sit and recline on a salon chair 202 and the stylist 300 can easily wash the hair 204 with water 504 using a faucet 502. The user's hair 204 is hung inside the cavity of the sink device 100, and is easily accommodated in the cavity 114 without touching the drain outlet and accumulated wastewater, thereby providing hygiene and safety to both the user 200 and the stylist 300.

The shampoo sink device 100 of the present invention conserves water because only a small quantity of water is required to wash hair, style hair, apply toner, color, shampoo and/or remove chemical treatments or the like from a user's hair. Also, less hot water is required to rinse the hair, so less energy is needed to heat the water. Therefore, the shampoo sink device 100 also comprises environmental benefits. Of course, the placement of the hot and cold water handle(s), as well as the hose and the nozzle are up to the designer or manufacturer. For example, most shampoo bowls or sinks will have a porcelain lip on the edge where these items are typically placed or houses. However, for a more sleek appearance, said devices may also be placed elsewhere, such as on the supply or drain line, or on a hook or latch placed on the side of the shampoo sink device 100.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "long hair shampoo bowl device", "long hair shampooing and washing bowl device", "shampooing sink device", "shampooing bowl device", "shampoo sink device" and "bowl device", are interchangeable and refer to the long hair shampooing and washing bowl device 100 of the present invention.

Notwithstanding the forgoing, the long hair shampoo bowl device 100 of the present invention can be of any suitable size and configuration as is known in the art without affecting the overall concept of the invention, provided that it accomplishes the above-stated objectives. One of ordinary skill in the art will appreciate that the size, configuration, and material of the long hair shampooing and washing bowl device 100 as shown in FIGS. 1-5 is for illustrative purposes only, and that many other sizes and shapes of the long hair shampooing and washing bowl device 100 are well within the scope of the present disclosure. Although the dimensions of the long hair shampooing and washing bowl device 100 are important design parameters for user convenience, the long hair shampooing and washing bowl device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features, and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A long hair shampooing and washing bowl device for washing and rinsing a user's hair at a salon, the long hair shampooing and washing bowl device comprising:

a pair of opposing side walls;

a front wall; and a rear wall, wherein the pair of opposing side walls, the front wall, and the rear wall comprise a cavity, and further wherein the front wall comprises a U-shaped notch for supporting a user's neck during a shampooing wherein the pair of opposing side walls, the front wall, and the rear wall which form the cavity are all integrally molded to form a single piece construction; and further wherein the rear wall comprises a deep U-shaped cut-out allowing easy access to a user's hair.

2. The long hair shampooing and washing bowl device of claim 1, wherein the rear wall comprises a height less than the front wall because of the deep U-shaped cut-out.

3. The long hair shampooing and washing bowl device of claim 2 further comprising a drain outlet disposed at a bottom center of the cavity.

4. The long hair shampooing and washing bowl device of claim 3, wherein the drain outlet is connected to a drainage pipe for draining water.

5. The long hair shampooing and washing bowl device of claim 4, wherein the drainage pipe can be placed over a floor drain.

6. The long hair shampooing and washing bowl device of claim 3, wherein the pair of opposing side walls, the front wall, and the rear wall slant upwards and outwards from the drain outlet towards a top of the cavity.

7. The long hair shampooing and washing bowl device of claim 6, wherein the pair of opposing side walls, the front wall, and the rear wall slant at approximately thirty degrees from a virtual longitudinal axis.

8. The long hair shampooing and washing bowl device of claim 7, wherein vertical distance between the U-shaped notch and the drain outlet is at least three feet.

9. The long hair shampooing and washing bowl device of claim 4 further comprising a broad base connected to the drainage pipe to allow the long hair shampooing and washing bowl device to be placed on a flat surface.

10. A long hair shampooing and washing bowl device for washing and rinsing a user's long hair at a salon, the long hair shampooing and washing bowl device comprising:

a pair of opposing side walls;

a front wall comprising a U-shaped notch for supporting a user's neck during a shampooing; and a rear wall comprising a deep U-shaped cut-out allowing easy access to a user's hair, wherein the pair of opposing side walls, the front wall, and the rear wall comprise a cavity, wherein the cavity comprises a drain outlet disposed at a bottom center of the cavity, and further wherein the pair of opposing side walls, the front wall, and the rear wall slant upwards and outwards from the drain outlet towards a top of the cavity.

11. The long hair shampooing and washing bowl device of claim 10, wherein the rear wall comprises a height less than the front wall because of the deep U-shaped cut-out.

12. The long hair shampooing and washing bowl device of claim 11, wherein the pair of opposing side walls, the front wall, and the rear wall slant at approximately thirty degrees from a virtual longitudinal axis.

13. The long hair shampooing and washing bowl device of claim 12, wherein vertical distance between the U-shaped notch and the drain outlet is at least three feet.

14. The long hair shampooing and washing bowl device of claim 13, wherein the drain outlet is connected to a drainage pipe for draining water.

15. A long hair shampooing and washing bowl device for washing and rinsing a user's hair at a salon, the long hair shampooing and washing bowl device comprising:

a pair of opposing side walls;

a front wall comprising a U-shaped notch for supporting a user's neck during a shampooing; and a rear wall comprising a deep U-shaped cut-out which causes a height of the rear wall to be less than a height of the front wall, wherein the pair of opposing side walls, the front wall, and the rear wall comprise a cavity having a drain outlet disposed at a bottom center of the cavity and connected to a drainage pipe, wherein the pair of opposing side walls, the front wall, and the rear wall slant upwards and outwards from the drain outlet at approximately thirty degrees from a virtual longitudinal axis, and further wherein a vertical distance between the U-shaped notch and the drain outlet is at least three feet.

* * * * *